US006823826B1

(12) United States Patent
Sugiura et al.

(10) Patent No.: US 6,823,826 B1
(45) Date of Patent: Nov. 30, 2004

(54) VARIABLE VALVE MECHANISM

(75) Inventors: Akira Sugiura, Anjo (JP); Kimihiko Todo, Chita-gun (JP); Hitoshi Tsuge, Hekinan (JP); Koichi Shimizu, Toyota (JP)

(73) Assignees: Otics Corporation, Nishio (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/722,670

(22) Filed: Nov. 24, 2003

(30) Foreign Application Priority Data

Nov. 29, 2002 (JP) ..... 2002-349227

(51) Int. Cl.[7] ..... F01L 1/34

(52) U.S. Cl. ..... 123/90.16; 123/90.17; 123/90.18; 123/90.2; 123/90.31

(58) Field of Search ..... 123/90.15–90.18, 123/90.2, 90.21, 90.27, 90.31, 90.44

(56) References Cited

U.S. PATENT DOCUMENTS 5,836,274 A * 11/1998 Saito et al. ..... 123/90.16
6,425,357 B2 * 7/2002 Shimizu et al. ..... 123/90.16
6,715,456 B2 * 4/2004 Wurms et al. ..... 123/90.16

FOREIGN PATENT DOCUMENTS

JP 2001-263015 9/2001

OTHER PUBLICATIONS

Patent Abstracts of Japan for JP2001–263015 published Sep. 26, 2001.

* cited by examiner

*Primary Examiner*—Thomas Denion
*Assistant Examiner*—Kyle M. Riddle
(74) *Attorney, Agent, or Firm*—Darby & Darby

(57) ABSTRACT

The current invention provides an inexpensive variable valve mechanism that includes a first intervening member which rotates a small angle rotation about an axis of a support shaft by being pressed by a rotating cam and a second intervening member which lifts a valve by making a small angle rotation about an axis of the support shaft together with the first intervening member thus pressing a cam corresponding part of a rocker arm. The variable valve mechanism further includes a control shaft which is provided concentrically with the support shaft, a slider which moves with the control shaft, a slanted part which is formed diagonally relative to the slider's movement direction and is in contact with the slider, and a relative rotation angle control device which varies the relative rotation angle of the first intervening member and the second intervening member by pressing the slanted part in a direction substantially perpendicular to the slider's movement direction by moving the slider together with the control shaft, thus varying the valve's lift and operating angle continuously.

5 Claims, 15 Drawing Sheets

VARIABLE VALVE MECHANISM

BACKGROUND OF THE INVENTION

1. Field of the Invention

The present invention relates to a variable valve mechanism that varies the lift and operating angle of the valve continuously or in steps depending on the operating condition of an internal combustion engine.

2. Description of Related Art

An exemplary variable valve mechanism of the prior art as discussed in Laid-open Japanese Patent Application No. 2001-263015 and shown in FIG. 15 comprises a first intervening member 84 pressed by a rotating cam (not shown) and a pair of second intervening members 86 provided on the left and right sides of the first intervening member 84 to press valves 91 via rocker arms 81 respectively mounted rotatably on a support shaft 82, wherein the relative rotating angle between the first intervening member 84 and the second intervening member 86 is changed by sliding a slider gear 89 via a control shaft 90 inserted slidably in the center of the support shaft 82, which the slider gear 89 being provided so that splines 87 and 88 formed inside of the first intervening member 84 and the second intervening member 86 can engaged.

Such a variable valve mechanism has the following problems:

(1) Machining of splines 87, 88 on the internal surfaces of the first intervening member 84 and the second intervening member 86 is difficult;

(2) In order to maintain a necessary sliding distance of the slider gear 89, there is a limit in shortening the span between the first intervening member 84 and the second intervening member 86 so that it is difficult to make the variable valve mechanism more compact;

(3) There are cases where fluctuations occur in the lift among valves 91 as only a portion of each second intervening member 86 is supported by the support shaft 82 among the first intervening member 84 and a pair of second intervening members 86 with both the first intervening member 84 and second intervening members 86 being unstable. In particular, when the lift among valves is small, the fluctuation of the lift becomes too large making the combustion of the internal combustion engine unstable; and, (4) Since the slider gear 89 typically has several dozen teeth, there is no guarantee that all of the teeth are in contact with the teeth of splines 87 and 88 so that it becomes impossible to change the lift smoothly from a low lift to a high lift when some teeth of the slider gear 89 cause irregular shifting.

SUMMARY OF THE INVENTION

At least one object of the current invention is to provide an inexpensive variable valve mechanism that solves the abovementioned problems, which is compact and has no variation in the left and right valve lift.

In order to solve the aforementioned problems, the variable valve mechanism of this invention includes the following features. A first intervening member rotates a small angle rotation about an axis of a support shaft by being pressed by a rotating cam. A second intervening member lifts a valve by making a small angle rotation about an axis of said support shaft together with said first intervening member thus pressing a cam corresponding part of a rocker arm. A control shaft is provided concentrically with said support shaft A slider moves with said control shaft. A slanted part, which contacts with said slider, is formed diagonally relative to said slider's movement direction. Finally, a relative rotation angle control device varies the relative rotation angle of said first intervening member and said second intervening member by pressing said slanted part in a direction substantially perpendicular to said slider's movement direction by moving said slider together with said control shaft. Thereby, the valve's lift and operating angle is varied continuously or in steps in response to the operating condition of an internal combustion engine. The cam corresponding part is a part pressed against the rotating cam in correspondence with the first intervening member and the second intervening member in that order.

Other objects and features of the present invention will become apparent from the following detailed description considered in conjunction with the accompanying drawings. It is to be understood, however, that the drawings are designed solely for the purpose of illustration and not as a definition of the invention, for which reference should be made to the appended claims.

BRIEF DESCRIPTION OF THE DRAWINGS

The foregoing and other features of the present invention will be more readily apparent from the following detailed description and drawings of an illustrative embodiment of the invention in which.

DETAILED DESCRIPTION OF THE PREFERRED EMBODIMENTS

A first embodiment of the variable valve mechanism according to the present invention will be described below with reference to FIGS. 1–8.

Figure 1:
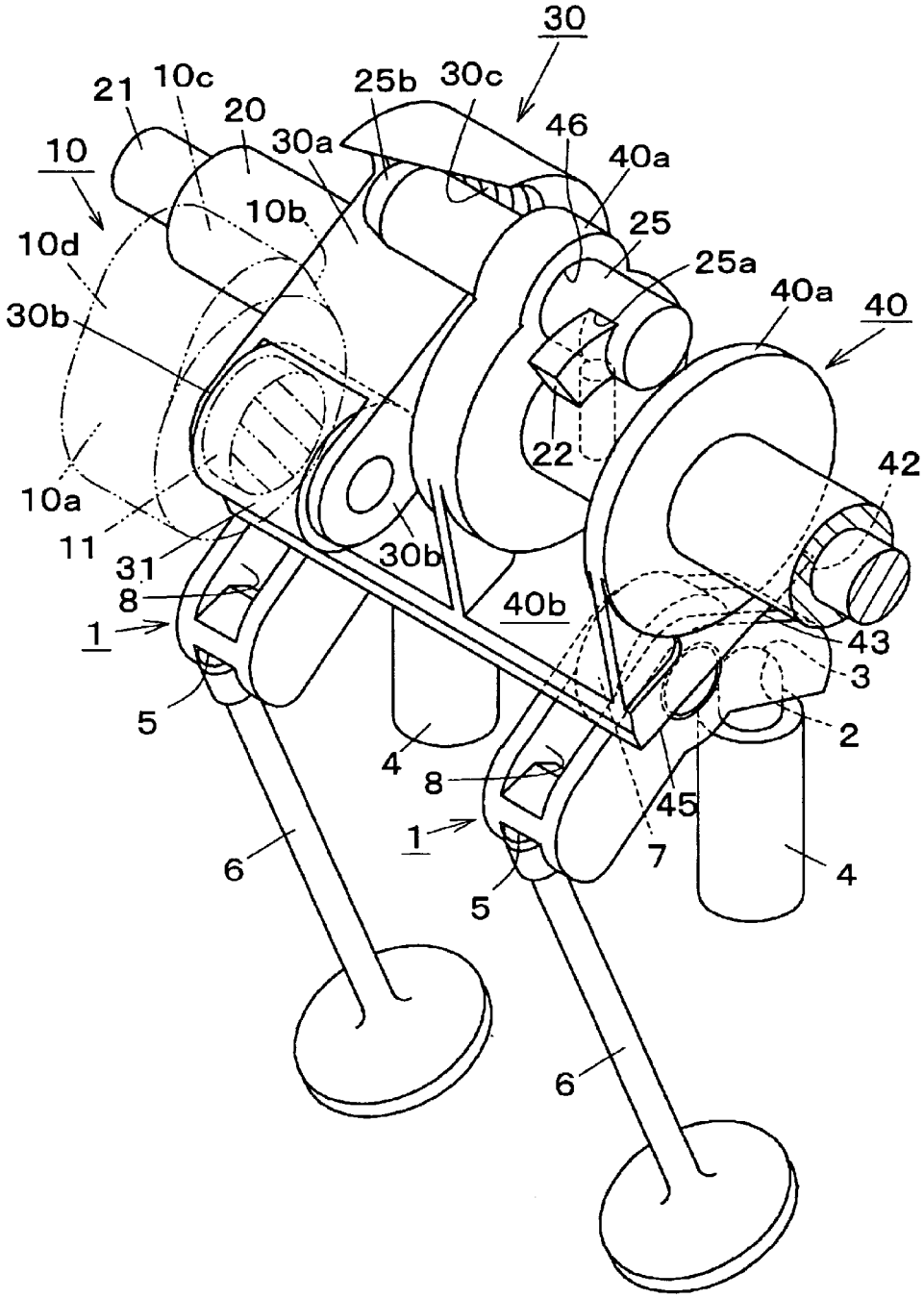
FIG. 1 depicts a perspective view of a variable valve mechanism according to a first embodiment of the present invention.
Figure 2A:
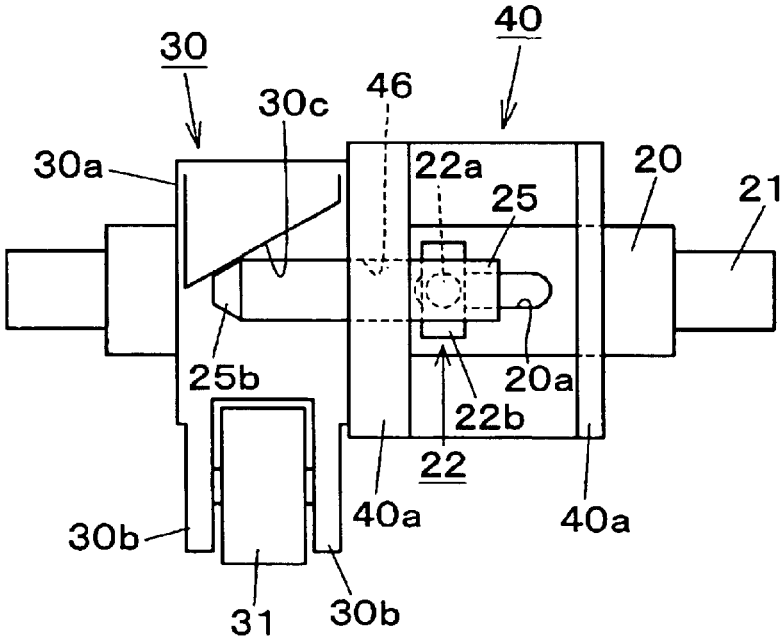
FIG. 2A depicts a plan view of at least some components of the variable valve mechanism of the present invention when a maximum lift and a maximum operating angle are required.
Figure 2B:
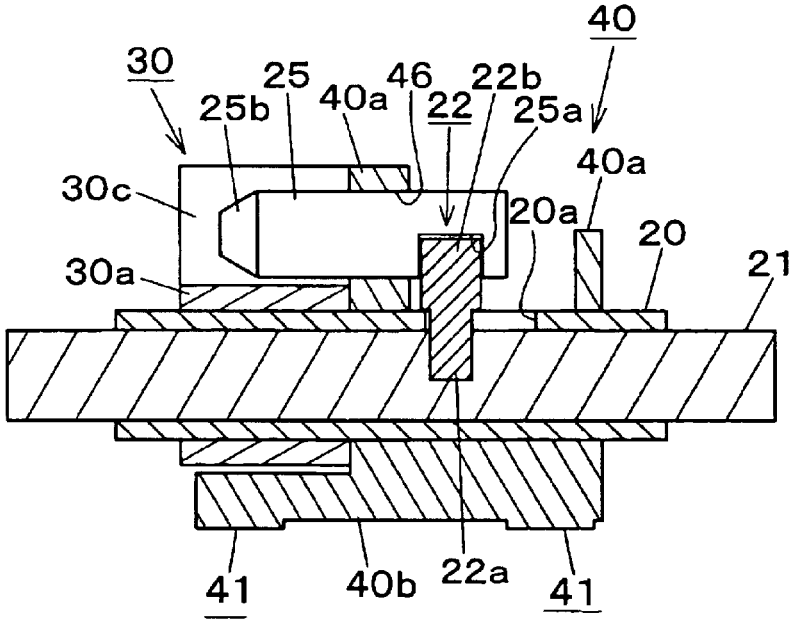
FIG. 2B depicts a cross-sectional view of at least some components of the variable valve mechanism in FIG. 2A.

As shown in FIG. 1 and FIGS. 2A–2B, the variable valve mechanism of this embodiment includes a first intervening member 30 that rotates a small angle which is not more than 360 degrees about the axis of a support shaft 20 by being pressed by a rotating cam 10 and a second intervening member 40 that lifts a valve 6 by pressing the cam corresponding part of a rocker arm 1 as it rotates a small angle which is not more than 360 degrees about the axis of the support shaft 20 together with the first intervening member 30. The rotation angle between the first intervening member 30 and the second intervening member 40 is changed by the movement of a control shaft 21 provided concentrically within the support shaft 20.

The rotating cam 10 is formed on a camshaft 11, which is rotatably supported. The rotating cam 10 includes a base circle 10*a*, a nose rising ramp 10*b* where the protrusion amount increases gradually, a nose 10*c* which is the point of maximum protrusion, and a nose falling ramp 10*d* where the protrusion amount decreases gradually.

A plurality (two in the case shown) of swing arm type rocker arms 1 is provided beneath the camshaft 11 corresponding to a plurality (two in the case shown) of valves 6. One end of each rocker arm 1 serves as a rocking fulcrum as a concave spherical part 2 formed therein is supported by a pivot 3. A concave valve pressing part 5, which presses the valve 6 at its proximal end, is provided on the other end of each rocker arm 1.

A roller placement hole 8 formed in the center of each rocker arm 1 is provided with a first roller 7 that serves as the cam corresponding part protruding slightly above the top surface of the rocker arm 1, said first roller 7 being rotatably mounted on a shaft that perpendicularly intersects with the arm sidewall.

A male screw provided below the shaft of the pivot 3 is adjustably inserted into a female screw provided on a pivot support member 4, thus forming a tappet clearance adjusting mechanism. The tappet clearance adjusting mechanism can be changed to one that automatically adjusts the tappet clearance by means of hydraulically displaced pivot 3 in a vertical direction relative to the pivot support member 4.

The cylindrical support shaft 20 is provided between two rocker arms 1 and the rotating cam 10, said shaft being supported by shaft supporting members (not shown) unrotatably. The first intervening member 30 and the second intervening member 40 are provided to the outer circumference of the support shaft 20 so as to make a small angle of rotation. The second intervening member 40 is provided with a slider 25 that displaces with the control shaft 21, and the first intervening member 30 is provided with a slanted part 30*c* formed diagonally with respect to the displacement direction of the slider 25 to be in contact with said slider 25.

The control shaft 21 is inserted slidably into the inside of the support shaft 20, and a bush 22 is provided to protrude radially at one location of the control shaft 21. The bush 22 comprises a trunk 22*a* having a rod-like shape and a tip 22*b* formed in a shape substantially similar to the shape of a disc concentric with the support shaft 20. In order to allow the bush 22 to be displaced in the axial direction of the support shaft 20 in accordance with sliding of the control shaft 21, a long hole 20*a* is provided in one part of the support shaft 20 extending in the axial direction of the support shaft 20 also allowing the trunk 22*a* of the bush 22 to be inserted therein.

The first intervening member 30 is equipped with a cylindrically shaped proximal end 30*a* mounted on the support shaft 20, and a pair of roller supporting parts 30*b* protruding in a substantially horizontal direction from said proximal end 30*a*. A second roller 31 is provided between said pair of roller supporting parts 30*b* to be pressed by the rotating cam 10, while said second roller 31 is rotatably mounted on and about a shaft that perpendicularly intersects with the sidewall of the roller supporting part 30*b*.

On top of the proximal end 30*a* is provided the slanted part 30*c* that is in contact with the tip of the slider 25, which is to be described later. The slanted part 30*c* extends diagonally from the rocking center side to the valve pressing side of the rocker arm 1 in accordance with the direction extending from the second intervening member 40 to the first intervening member 30.

The second intervening member 40 comprises a pair of cylindrical parts 40*a* mounted on the support shaft 20 with a certain distance of separation, and an arm part 40*b* bridging the bottoms of cylindrical parts 40*a* and extending to the valve pressing side of the rocker arm 1. The arm part 40*b* extends further leftward (in FIG. 1) from the left side cylindrical part 40*a* as far as the left end of the first intervening member 30. Also, at the bottoms of the left end and the right end of the arm part 40*b* formed are pressing parts 41 having substantially the same width as that of the first roller 7.

Each pressing part 41 includes a cylindrical part 42 formed on the underside of the cylindrical part 40*a*, a flat part 45 extending from the cylindrical part 42 smoothly connecting to the lower proximal end of the arm part 40*b* and extending to the lower tip of the arm 40*b*, and a boundary area 43 between the cylindrical part 42 and a flat part 45. The cylindrical part 42 is formed in an arc-like shape with a large radius concentric with the cylindrical part 40*a*. The flat part 45 is formed substantially flat to extend slightly downward from the bottom face of the arm part 40*b*. The boundary area 43 is located between the cylindrical part 42 and the flat part 45, and connects the cylindrical part 42 with the flat part 45 with a smooth curve. The second intervening member 40 is constantly energized in the direction to cause the pressing part 41 to move upward by an energizing means (not shown).

The tip 22*b* of the bush 22 passes through an opening formed between the pair of cylindrical parts 40*a* with some margin, so that second intervening member 40 can make a small angle rotation about the axis of the support shaft 20.

A sliding hole 46 is provided on the top of the cylindrical part 40*a* adjacent to the first intervening member 30 extending in parallel with the support shaft 20, while said slider 25 is slidably inserted in said sliding hole 46 in the axial direction of the support shaft 20. The slider 25 is formed in a rod-like shape and an engaging groove 25*a* is formed on the slider 25 close to its right edge to engage with the bush 22 allowing the second intervening member 40, which is accompanied with the slider 25, to make a small angle rotation.

The engaging groove 25*a* is formed to extend in the cross-sectional direction of the slider 25 from the bottom edge of the slider 25 almost to the center, so that the tip 22*b* of bush 22 engages with it snugly in the longitudinal direction of the slider 25 and the tip 22*b* of bush 22 slides smoothly in the cross sectional area of the support shaft 20.

Also, at the left edge of the slider 25 formed is a chamfered part 25*b*. Therefore, although the slider 25 is slanted relative to the slanted part 30*c*, the slider 25 and the slanted part 30*c* make surface contact at the chamfered part 25*b*.

A relative rotation angle control device is formed on the control shaft 21, which changes the lift and operating angle of the valve 6 either continuously or in steps (however, preferably more than three steps, and more preferably more than four steps) according to the operating condition of the internal combustion engine. The relative rotation angle control device changes the rotating angle between the first intervening member 30 and the second intervening member 40 by means of causing said control shaft 21 to move longitudinally to push the slanted part 30*c* in a direction substantially perpendicular to the displacement direction of the slider 25 thus in turn causing the slider 25 to be displaced by the bush 22. In other words, when the control shaft 21 moves in the longitudinal direction, the slider 25 slides in the longitudinal direction via the bush 22. In so doing, the tip of slider 25 pushes the slanted part 30*c*, and thereby attempts to separate the second intervening member 40 from the first intervening member 30, and also to change the angle of rotation of the second intervening members relative to the first intervening member 30. However, since the first intervening member 30 and the second intervening member 40 are both mounted on the support shaft 20 so, the first intervening member 30 cannot be separated from the second intervening member 40. Rather, the second intervening member 40 rotates a small angle relative to the first intervening member 30, thus causing a change in the angle of rotation between the first intervening member 30 and the second intervening member 40. The angle of rotation change is controlled by a controller such as a microcomputer based on the values detected by the internal combustion engine's rotation sensor, accelerator opening sensor, etc.

When the rotating cam 10 rotates to push the first intervening member 30, the second intervening member 40 rotates a small angle about the axis of the support shaft 20 together with the first intervening member 30, and the pair of pressing parts 41 of the second intervening member 40 press against the two first rollers 7 so that the two rocker arms 1 rock to lift the valve 6. The energizing means not only energizes the second intervening member 40 in the direction of causing the arm 40*b* to move upward, but also energizes the first intervening member 30 in the same direction as the slider 25 is abutted against the slanted part 30*c*. Because the second roller 31, which is mounted on the roller supporting part 30*b*, becomes energized in the direction toward the rotating cam 10 the second roller 31 is always in contact with the rotating cam 10.

Figures 3A, 3B:
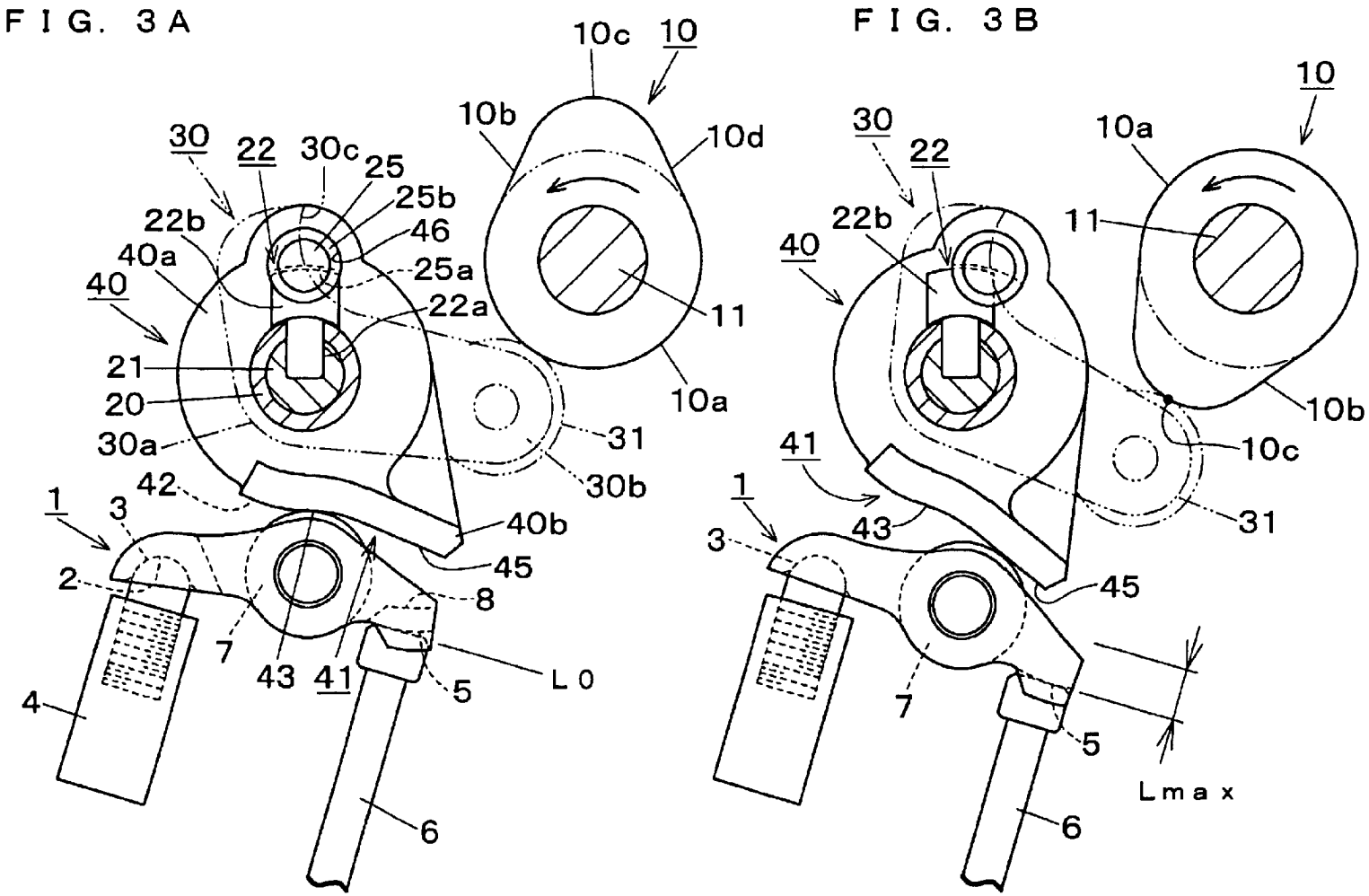
FIG. 3A depicts a side view of the variable valve mechanism in FIG. 2A when the abutting position of a rotating cam on a second roller is at the base position.
FIG. 3B depicts a side view of the variable valve mechanism in FIG. 2A showing when the abutting position of a rotating cam on a second roller is at the nose position.

Therefore, the first intervening member 30 remains in the small angle rotation start position when the second roller 31 is in contact with the base circle 10*a* of the rotating cam 10 (i.e., it is at the base). However, when the second roller 31 starts to contact with the nose rising ramp 10*b*, the protrusion of the rotating cam 10 increases, so that the first intervening member 30 starts to make a small angle rotation in a clockwise direction as shown in FIG. 3A, and this small angle rotation of the first intervening member 30 continues with the rotation of the rotating cam 10.

When the contact position of the second roller 31 on the rotating cam 10 shifts to the nose 10*c* (i.e., at the nose), the small angle rotation of the first intervening member 30 halts and the first intervening member 30 reaches the end position of the angle of rotation. When the rotation of rotating cam 10 advances further and the contact position of the second roller 31 reaches the nose falling ramp 10*d*, the protrusion of the rotating cam 10 decreases so that the first intervening member 30 starts a counterclockwise rotation, and the first intervening member 30 returns to the small angle rotation start position when the contact position of the second roller 31 returns to the base circle 10*a*. In other words, the first intervening member 30 repeats reciprocating motions between the small angle rotation start position and the small angle rotation end position, while the second intervening member 40 also makes reciprocating motions together with the first intervening member 30.

Moreover, as the relative rotation angle of the second intervening member 40 relative to the first intervening member 30 is changed by means of the relative rotation angle control device, the small angle rotation start position and the small angle rotation end position of the second intervening member 40 shift the same degree in the same direction. This means changing the angular difference of the second intervening member 40 between the position at the small angle rotation start position and the position when it causes the first roller 7 to begin contacting the boundary area 43. Therefore, the smaller the angular difference of the second intervening member, the less time until the first roller 7 contacts the boundary area 43. In other words, when the rotation angle of the second intervening member 40 relative to the first intervening member 30 is changed, the contact position of the first roller 7 relative to the pressing parts 41 is changed. Consequently, the pressing amount of the first roller 7 is changed, so that the pressing amount of the rocker arm 1 and its operating angle can be changed.

The variable valve mechanism constituted as such works as follows.

FIGS. 2A–2B show the position of slider 25 in the operating condition wherein a maximum lift and a maximum angle of operation are required, and FIGS. 3A–3B show the relative rotation angle between the first intervening member 30 and the second intervening member 40 when the maximum lift and the maximum angle of operation are required. The bush 22 presses against the slanted part 30*c* with the help of the slider 25 that engages with tip 22*b*. Consequently, the relative rotation angle of the first intervening member 30 and the second intervening member 40 is changed until the second roller 31 and the pressing parts 41 are distanced farthest apart.

When the rotating cam 10 is in contact with the second roller 31 on the base circle 10*a* (i.e., at the base) as shown in FIG. 3A, the first intervening member 30 and the second intervening member 40 remain at the small angle rotation start position. Since the relative rotation angle between the first intervening member 30 and the second intervening member 40 is controlled in such a way that two valves 6 assume the maximum lift and the maximum operating angle at that time, the pressing parts 41 are controlled to be at a lowest position relative to the second roller 31. Two first rollers 7 mounted on two rocker arms 1 are located at this time at the highest positions, each contacting a position in the vicinity of the boundary area 43 of the pressing parts 41 of the second intervening part 40. Each rocker arm 1 then remains at the highest position, and the lift of wo valves 6 is zero.

Next, during the period of FIG. 3A through FIG. 3B, i.e., when the contact point of the rotating cam 10 on the second roller 31 shifts from base circle 10*a* to nose rising ramp 10*b*, the second roller 31 is pressed downward by the rotating cam 10 and the first intervening member 30 starts a small angle rotation in the clockwise direction. Meanwhile, the second intervening member 40 starts a small angle rotation along with the first intervening member 30. At this time, the pressing parts 41 of the second intervening member 40 start to press the two first rollers 7 downward by shifting their positions relative to the two first rollers 7 from the boundary area 43 to the flat part 45. The two rocker arms 1 start to move downward about each pivot 3 in response to the pressure caused by the two first rollers 7. In addition, the valve pressing parts 5 press the two valves 6 downward thereby lifting each valve 6.

When the contact position of the rotating cam 10 on the second roller 31 is at the position of the nose 10*c* (i.e., at the nose) as shown in FIG. 3B, the second roller 31 receives the maximum pressure from the rotating cam 10 and reaches the maximum press down position. Consequently, the first intervening member 30 and the second intervening member 40 reach the small angle rotation end positions. At this time, the pressing parts 41 of the second intervening member 40 press the two first rollers 7 furthest downward by shifting their positions relative to the two first rollers 7 to the vicinity of the distal end of the flat part 45. The two rocker arms 1 thus make their maximum downward motions, thereby increasing the lifts L of the two valves 6 to their maximum Lmax. Since first rollers 7 are already in the vicinity of boundary area 43 when the contact position of the rotating cam 10 on the second roller 31 is at the base, and the two valves 6 have begun to be lifted in a wide range from the small angle rotation start position of the second intervening member 40 to the small angle rotation end position, the angle of operation also reaches its maximum.

Figure 4A:
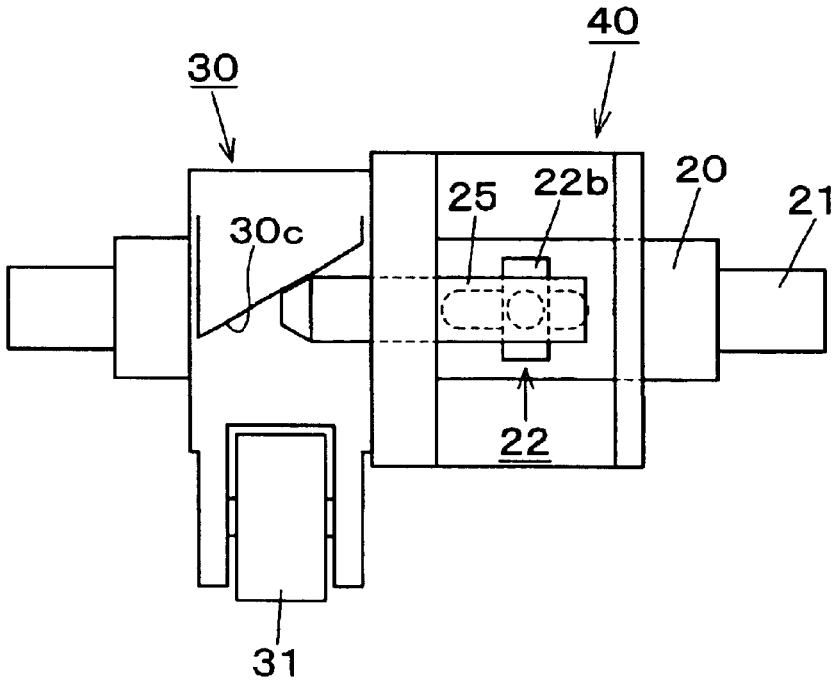
FIG. 4A depicts a plan view of at least some components of the variable valve mechanism of the present invention when a minute lift and a minute operating angle are required.
Figure 4B:
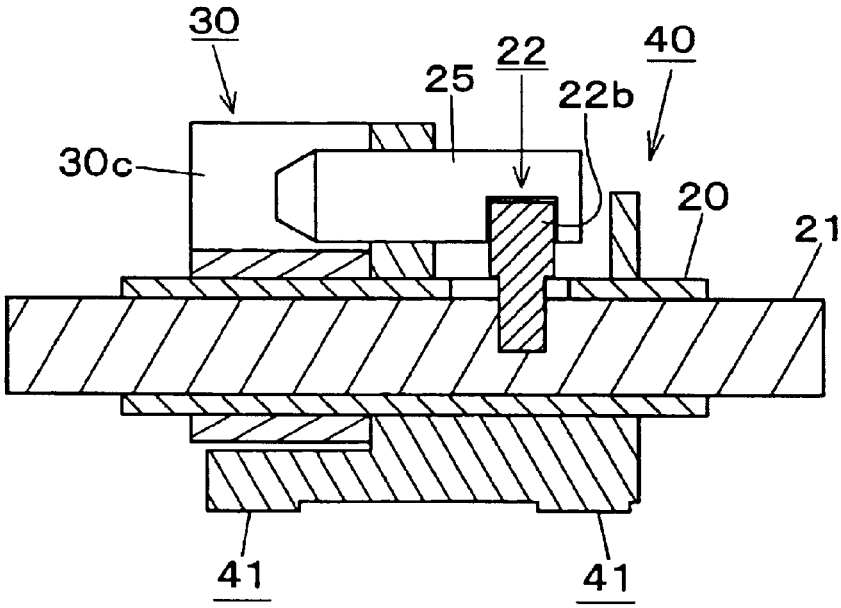
FIG. 4B depicts a cross-sectional view of at least some components of the variable valve mechanism in FIG. 4A.
Figure 5B:
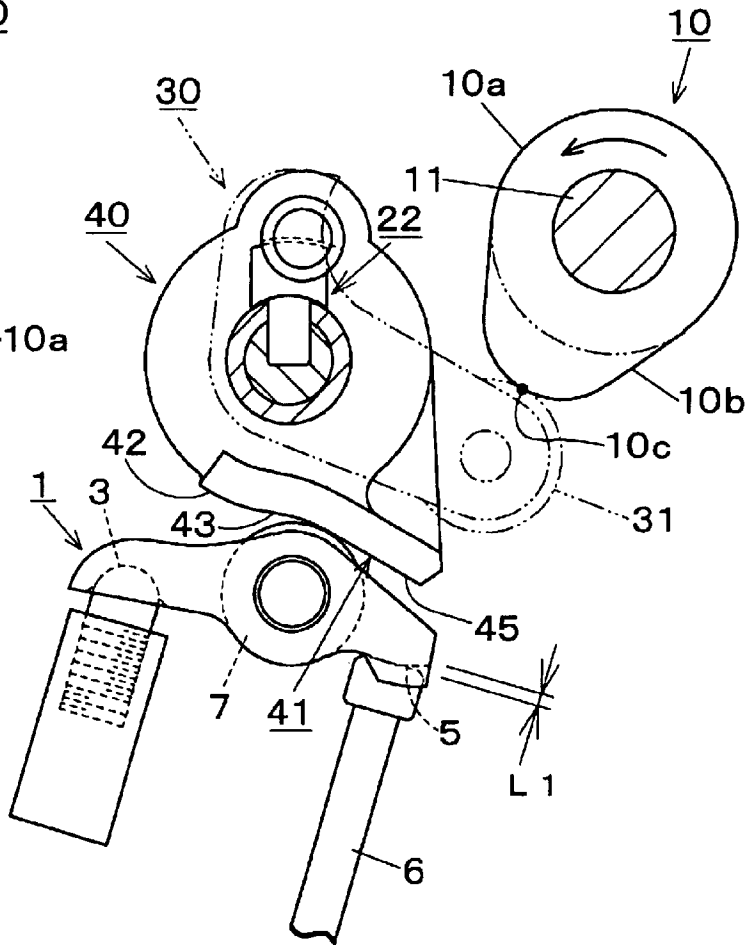
FIG. 5B depicts a side view of the variable valve mechanism in FIG. 4A when the abutting position of the rotating cam on the second roller is at the nose position.
Figure 5A:
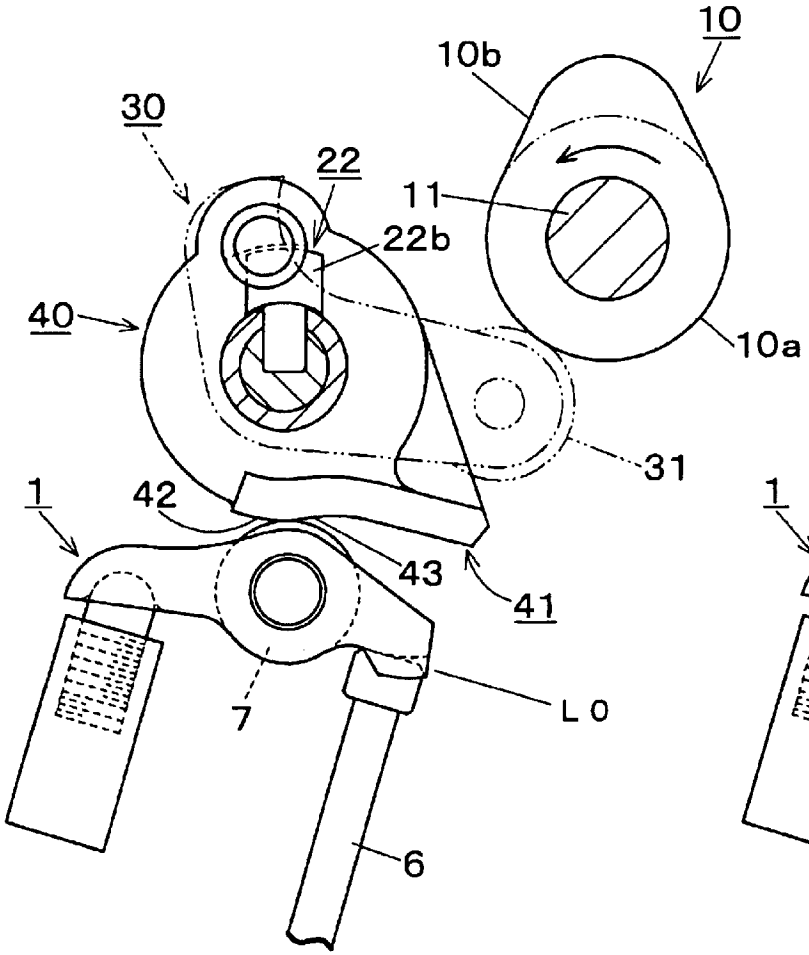
FIG. 5A depicts a side view of the variable valve mechanism in FIG. 4A when the abutting position of the rotating cam on the second roller is at the base position.

Next, FIG. 4A and FIG. 4B show the position of the slider 25 in the operating condition wherein a minute lift and a minute angle of operation is required. FIG. 5A and FIG. 5B show the relative rotation angle between the first intervening member 30 and the second intervening member 40 when a minute lift and a minute angle of operation are required. With such arrangement, the bush 22 moves to a position closest to its rightmost position while pressing the slanted part 30*c* with the help of slider 25 that engages with tip 22*b*. Consequently, the relative rotation angle of the first intervening member 30 and the second intervening member 40 is changed until the second roller 31 and the pressing part 41 come closest together.

When the rotating cam 10 is in contact with the second roller 31 on the base circle 10*a* (i.e., at the base) as shown in FIG. 5A, the first intervening member 30 and the second intervening member 40 remain at the small angle rotation start position. Since the relative rotation angle between the first intervening member 30 and the second intervening member 40 is controlled in such a way that the two valves 6 assume a minute lift and a minute operating angle at that time, the pressing part 41 is controlled to be at a highest position relative to the second roller 31. At this time, the two first rollers 7, which are mounted on the two rocker arms 1, are at their highest positions. In so doing, the two rocker arms 1 assume positions closest to the boundary area 43 of the cylindrical part 42, while each rocker arm remains at the highest position. With this arrangement, the lift of the two valves 6 is zero.

Next, during the period of FIG. 5A through FIG. 5B, i.e., when the contact point of the rotating cam 10 on the second roller 31 shifts from the base circle 10*a* to the nose rising ramp 10*b*, the second roller 31 is pressed downward by the rotating cam 10 and the first intervening member 30 starts a small angle rotation in the clockwise direction. Meanwhile, the second intervening member 40 starts a small angle rotation along with the first intervening member 30. The pressing parts 41 of the second intervening member 40 then shift their contact positions relative to the two first rollers 7 from the cylindrical part 42 to the flat part 45, and the two first rollers are pressed downward as the contact positions start to move toward the flat part 45. With this arrangement, the two rocker arms 1 move downward about each pivot 3 in response to the pressures the two first rollers 7 receive from the flat part 45. The two valve pressing parts 5 press the two valves 6 downward, which consequently lifts each valve 6.

When the contact position of the rotating cam 10 on the second roller 31 is at the position of the nose 10*c* (i.e., at the nose) as shown in FIG. 5B, the second roller 31 receives the maximum pressure from the rotating cam 10 and the second roller 31 reaches the maximum press down position. Consequently, the first intervening member 30 and the second intervening member 40 reach the small angle rotation end positions. At this time, the pressing parts 41 of the second intervening member 40 press the two first rollers 7 downward by shifting their positions relative to the two first rollers 7 to the vicinity of the proximal end of the flat part 45. The two rocker arms 1 make minute downward motions, thereby minutely increasing the lifts L of the two valves 6 to L1. Since the second intervening member 40 presses the two rocker arms 1 simultaneously, the two valves 6 are lifted by the same amount, thereby providing stable combustion actions to the internal combustion engine despite the minute lift. Moreover, because the two first rollers 7 are at contact positions close to the boundary area 43 of the cylindrical part 42 when the contact position of the rotating cam 10 on the second roller 31 is at the base, and further because the two valves 6 are not lifted until the second intervening member 40 makes a small angle rotation to reach the vicinity of the small angle rotation end position, the operating angle is minute.

Figure 8:
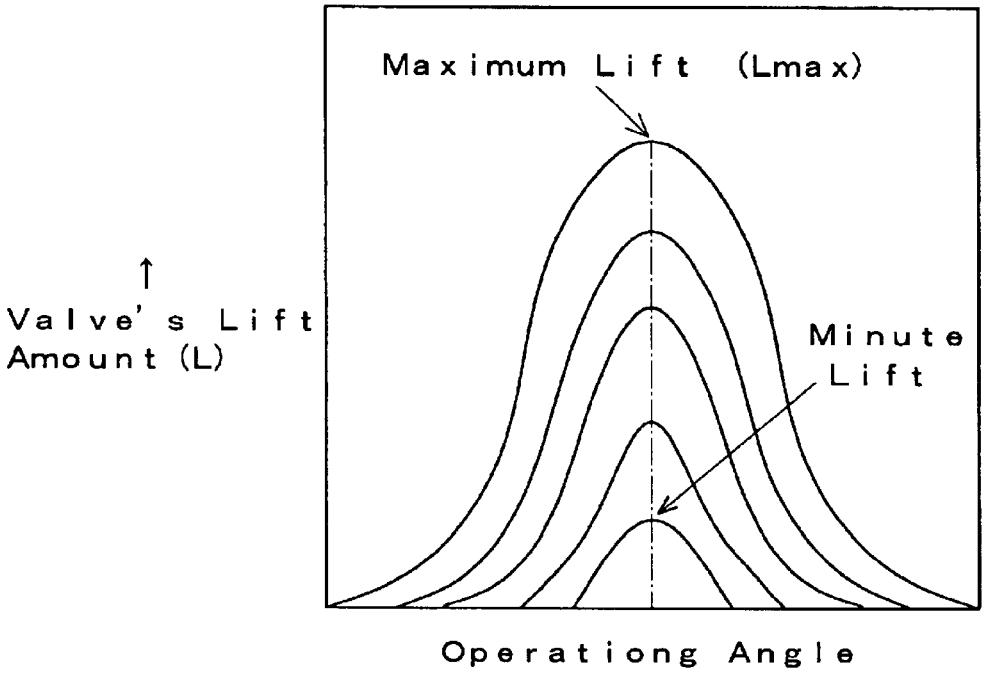
FIG. 8 depicts a graph showing the various lifts and operating angles achieved by the variable valve mechanism of the present invention.
Figure 9:
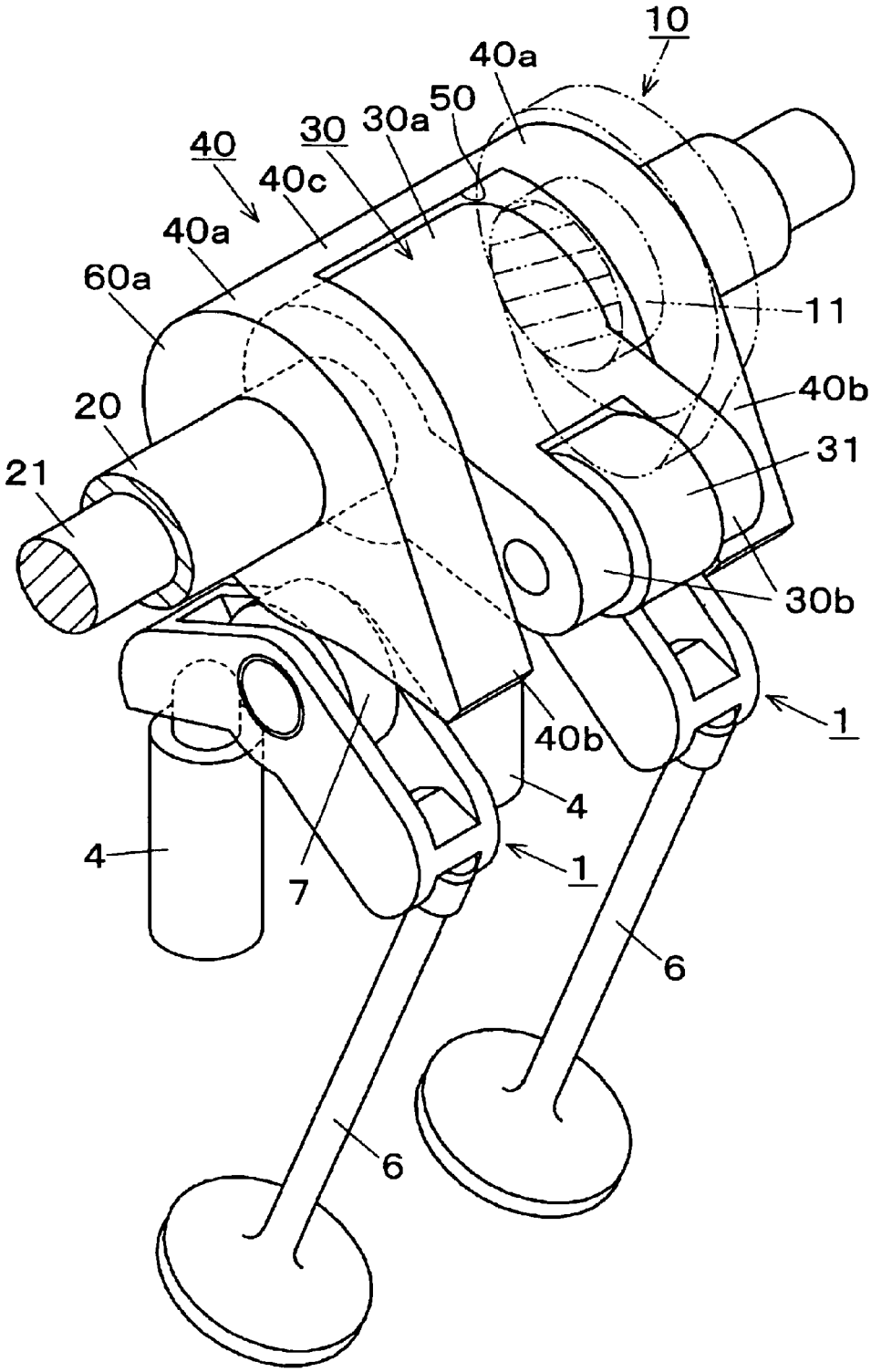
FIG. 9 depicts a perspective view of a variable valve mechanism according to a second embodiment of the present invention.
Figure 10A:
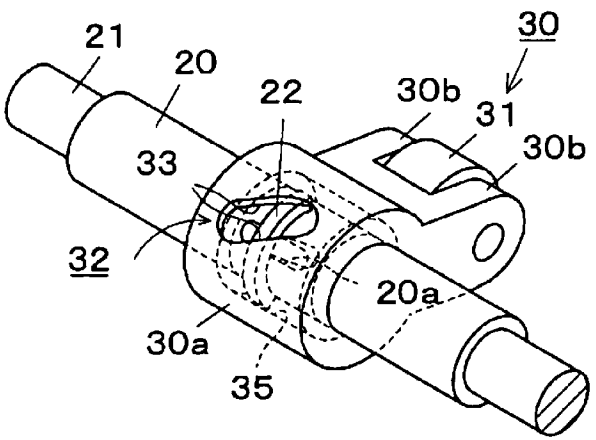
FIG. 10A depicts a perspective view of at least some components of the variable valve mechanism of the present invention except the second intervening member.
Figure 10B:
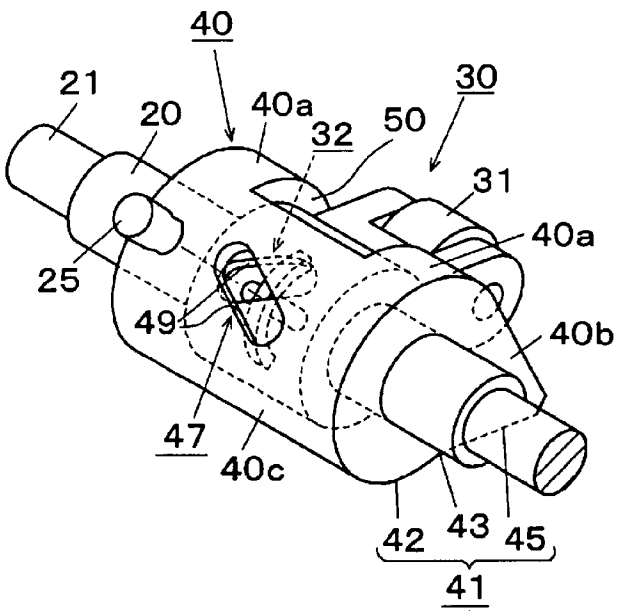
FIG. 10B depicts a perspective view of at least some components of the variable valve mechanism of the present invention.
Figure 10C:
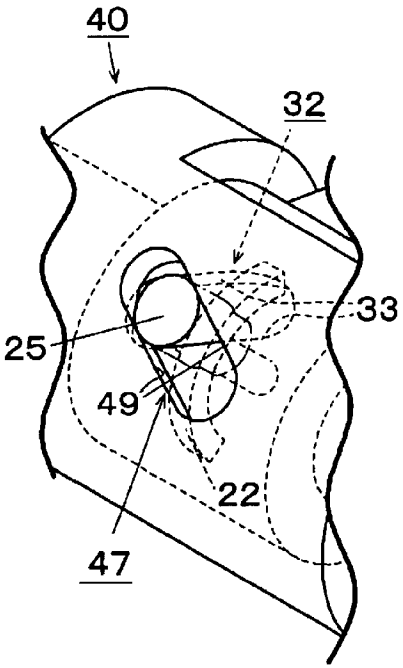
FIG. 10C depicts an enlarged perspective view of the variable valve mechanism in FIG. 10B when the slider is placed in the slit.
Figure 11:
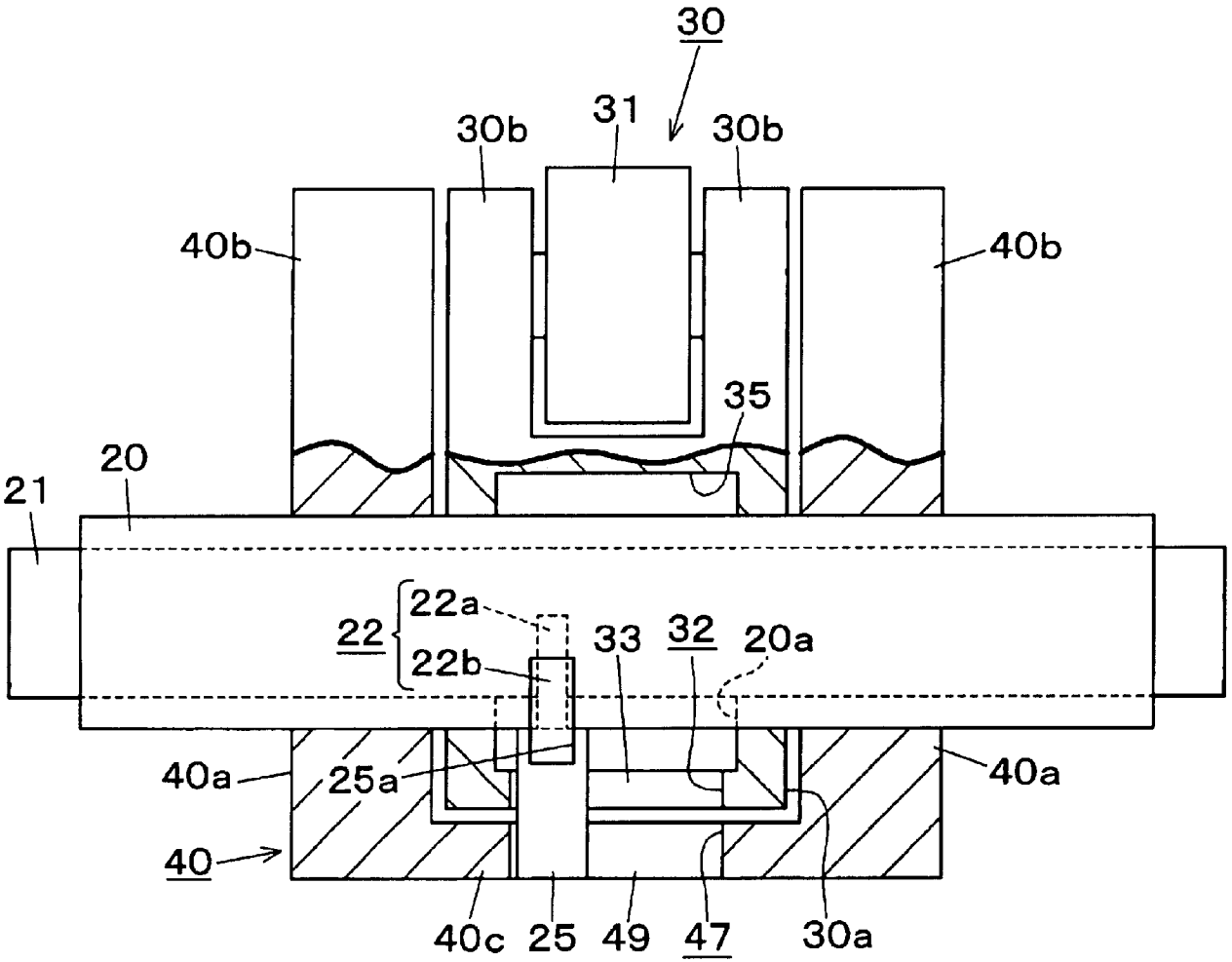
FIG. 11 depicts a plan view of at least some components of said variable valve mechanism of the present invention.
Figure 12:
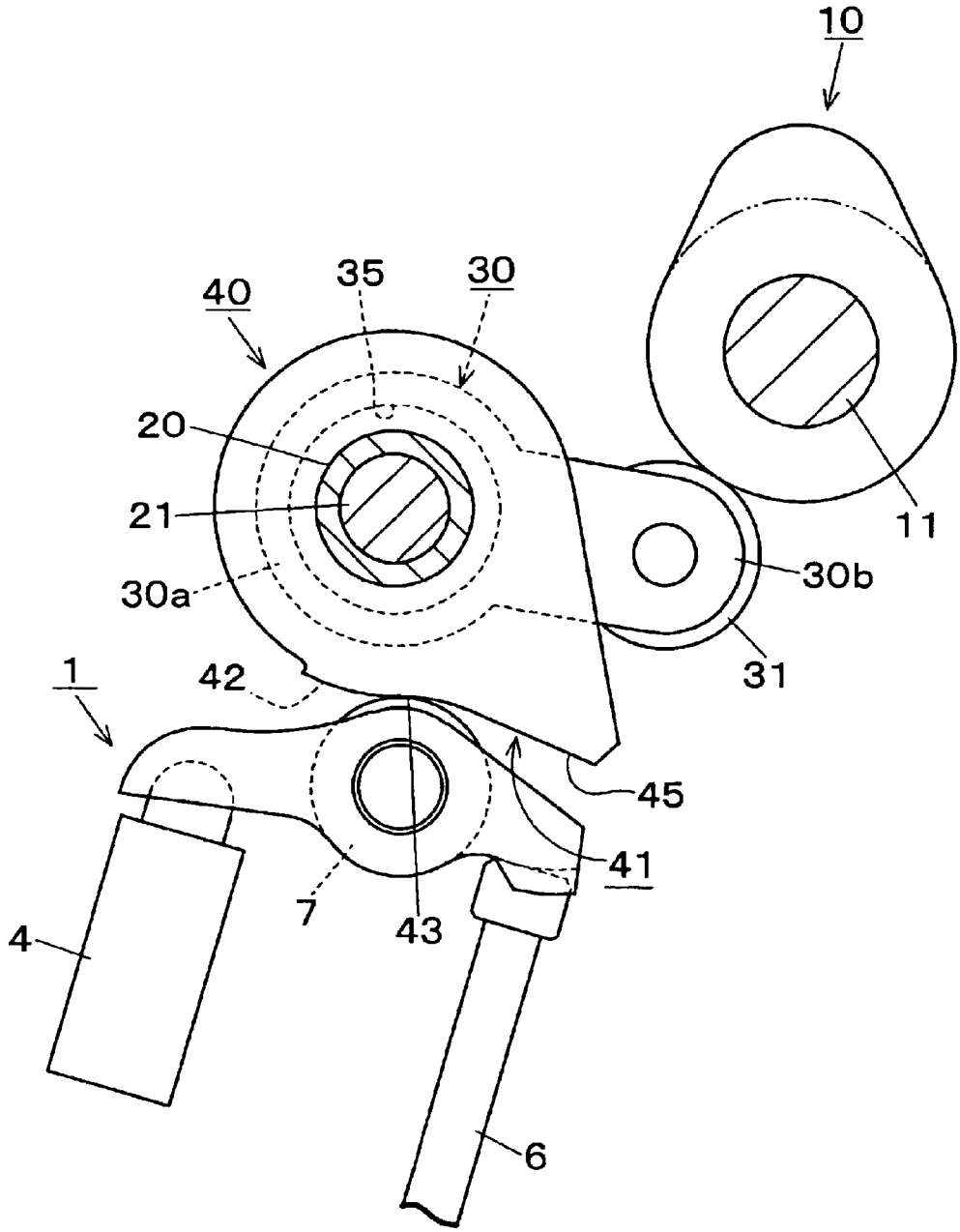
FIG. 12 depicts a side view of said variable valve mechanism of the present invention.

Furthermore, under an operating condition where an intermediate lift and an intermediate operating angle are required, the relative rotation angle between the first intervening member 30 and the second intervening member 40 is generated continuously or in steps by the relative rotational angle control device. Such a continuous or step variable valve arrangement is depicted in FIG. 8.

Figure 6A:
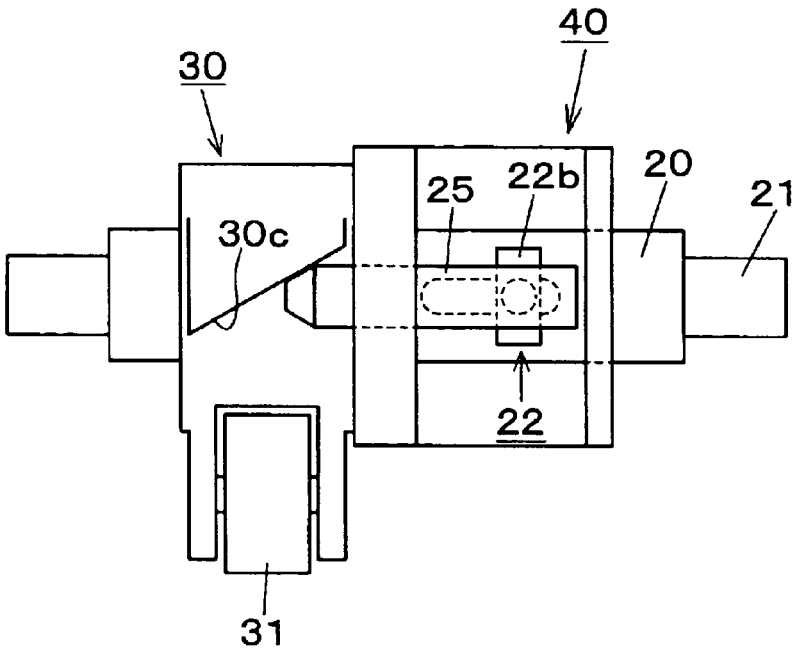
FIG. 6A depicts a plan view of at least some components of the variable valve mechanism of the present invention when a lift pause is required.
Figure 6B:
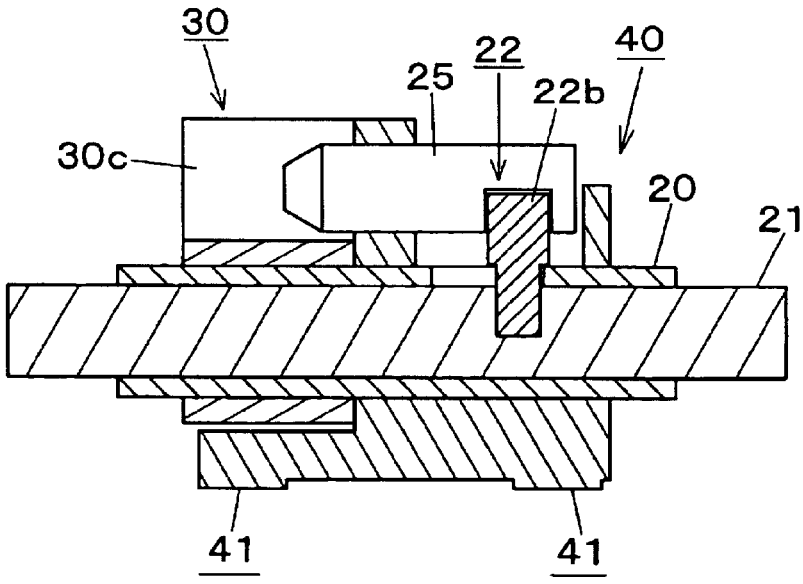
FIG. 6B depicts a cross-sectional view of at least some components of the variable valve mechanism in FIG. 6A.
Figure 7B:
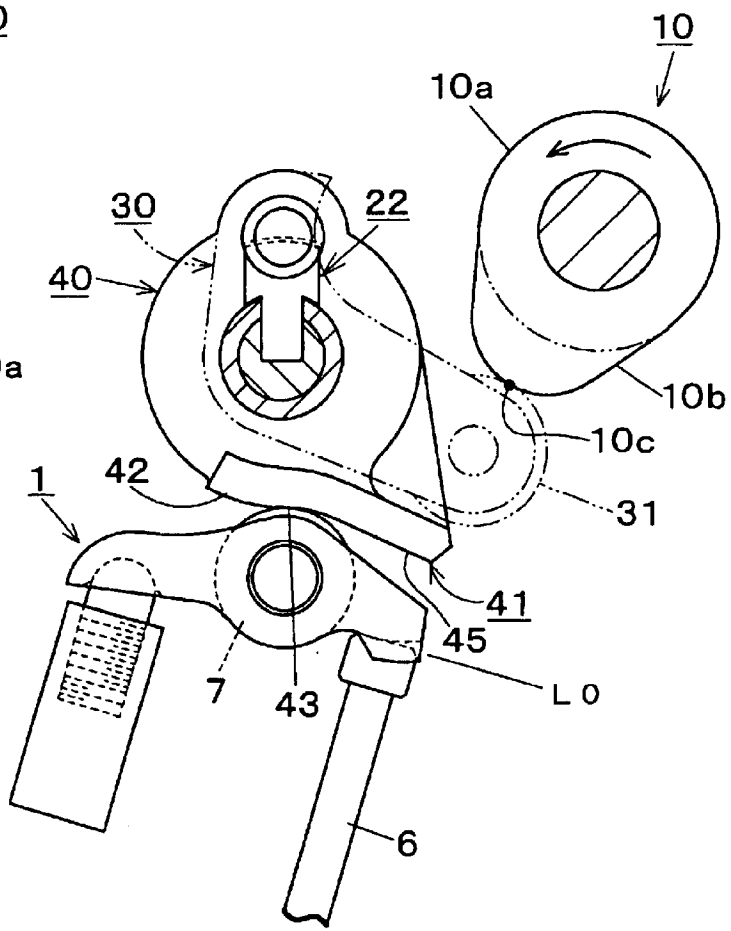
FIG. 7B depicts a side view of said mechanism in the same case as in FIG. 6A when the abutting position of the rotating cam on the second roller is at the nose position.
Figure 7A:
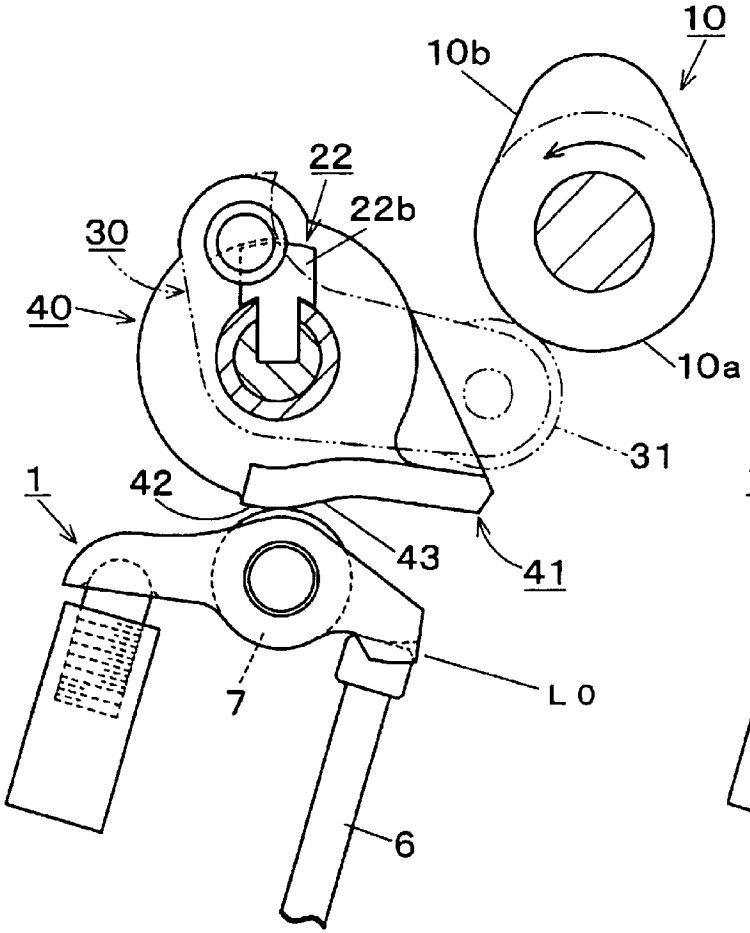
FIG. 7A depicts a side view of the variable valve mechanism in FIG. 6A when the abutting position of the rotating cam on the second roller is at the base position.

FIG. 6A and FIG. 6B show the position of the slider 25 in the operating condition wherein a lift pause is required, and FIG. 7A and FIG. 7B show the relative angle of rotation between the first intervening member 30 and the second intervening member 40 when a lift pause is required. The bush 22 moves to its rightmost position while pressing the slanted part 30*c* with the help of slider 25 that engages with tip 22*b*. Consequently, the relative rotation angle of the first intervening member 30 and the second intervening member 40 is changed until the second roller 31 and the pressing part 41 come to the closest position with respect to each other.

When the rotating cam 10 is in contact with the second roller 31 on the base circle 10*a* (i.e., at the base) as shown in FIG. 7A, the first intervening member 30 and the second intervening member 40 are stationary at the small angle rotation start position. The relative rotation angle of the first intervening member 30 and the second intervening member 40 is controlled in such a way as to make the lift at rest, while the pressing parts 41 are controlled to be at the highest position relative to the second roller 31. With this arrangement, the two first rollers 7, which are mounted on the two rocker arms 1, are at their highest positions, assuming positions approximately in the middle of the cylindrical part 42, while the two rocker arms 1 remain at the highest positions. Accordingly, the lift of the two valves 6 is zero.

Next, during the period of FIG. 7A through FIG. 7B, i.e., when the contact point of the rotating cam 10 on the second roller 31 shifts from the base circle 10*a* to the nose rising ramp 10*b*, the second roller 31 is pressed downward by the rotating cam 10 and the first intervening member 30 starts a small angle rotation in the clockwise direction. Meanwhile, the second intervening member 40 also starts a small angle rotation along with the first intervening member 30. Although the pressing parts 41 of the second intervening member 40 shift their contact positions against the two first rollers 7 from the positions approximately in the middle of the cylindrical part 42 to the boundary area 43, the contact positions are within the cylindrical part 42 such that the two first rollers 7 do not move. Because neither the two rocker arms 1 nor the two first rollers 7 move, the two valves 6 do not lift.

When the contact position of the rotating cam 10 on the second roller 31 is at the position of the nose 10*c* (i.e., at the nose) as shown in FIG. 7B, the second roller 31 receives the maximum pressure from the rotating cam 10 and reaches the maximum press down position. Consequently, the first intervening member 30 and the second intervening member 40 reach the small angle rotation end positions. At this time, although the pressing parts 41 of the second intervening member 40 shift their contact position from against the cylindrical part 42 to against the flat part 45 of the first rollers 7, they simply move from the position close to the boundary area 43 on the cylindrical part 42 or to the proximal end of the boundary 43, such that the two first rollers 7 do not move. With this arrangement, the two rocker arms 1 do not move, the two valves 6 are at a no lift condition and both lift and the operating angle is zero.

Because the variable valve mechanism of the present invention has no spline gear inside the first intervening member 30 and the second intervening member 40, an inexpensive and compact variable valve mechanism can be achieved. Moreover, since the second intervening member 40 that presses the two rocker arms 1 consists of a single member and is mounted on the support shaft 20, the two rocker arms 1 always function in unison consequently, eliminating any concerns for variations between the two rocker arm motions or variations between the lifts of the valves 6.

A second embodiment of the present invention is described below by noting the differences from the first embodiment and is illustrated in FIGS. 9–12. A variable valve mechanism of this embodiment differs form the first embodiment only in the constitutions of the slider, the first intervening member and the second intervening member.

A slider 25 and a slanted part 33 having a slit 32 are provide on the first intervening member 30, while a guide part 49 for guiding the displacement of the slider 25 is provided on the second intervening ember 40. The slider 25 is changed to a cylindrical rod extending in the radial direction of the support shaft 20, and a engaging groove 25*a* is moved to the proximal end of the slider 25 accordingly.

The first intervening member 30 is shifted to a position substantially in the middle of the two rocker arms 1. Also, a relief groove 35 is provided inside a proximal end 30*a* of the first intervening member 30 for storing the bush 22 which allows the bush 22 to move thereby preventing interferences with the distal end 22*b*.

The slit 32 is formed on the back of the proximal end 30*a* reaching from the outer surface of the proximal end 30*a* to the inner surface of the proximal end 30*a* and extending in a left-hand spiral (advances as it turns to left) shape around the support shaft 20, wherein a pair of slanted parts 33 facing with each other are provided by said slit 32.

The slit 32 is formed to have a width slightly larger than the diameter of the slider 25. The slider 25 is provided to be inserted in the slit 32 of the first intervening member 30, to be slid smoothly along in the longitudinal direction of the slit 32 while remaining in constant contact with at least one of the pair of slanted parts 33.

The positions of the pair of cylindrical parts 40*a* of the second intervening member 40 are modified to sandwich the first intervening member 30 from the left and right sides. Also, the arm part 40*b* is modified in such a way that its central portion except for the pressing part 41 is removed, and a bridging part 40*c* is formed so as to bridge a pair of cylindrical parts 40*a* at the rear ends of the pair of cylindrical parts 40*a*.

The bridging part 40*c* are formed in a cylindrical shape substantially larger than the proximal end 30*a* of the first intervening member 30, and an opening 50 is provided to extend from the center top side of the bridging part 40*c* to the center bottom side via the center front, so that a roller supporting part 30*b* of first intervening member 30 can pass freely through it and allow the rotation between the first intervening member 30 and the second intervening member 40.

A slit 47 is formed on the back of the bridging part 40*c* reaching from the outer surface of the bridging part 40*c* to the inner surface of the bridging part 40*c* and extends in a right-hand spiral shape around the support shaft 20. A pair of guide parts 49 is provided facing each other on the slit 47. In other words, the pair of guide parts 49 extends in a right-hand spiral (advances as it turns right) so that the displacement direction of the slider 25 is different from the direction of the pair of slanted parts 33 extending in the left-hand spiral. It is also possible to form a slit 32 in a right-hand spiral and a slit 47 in a light-hand spiral so that the control shaft 21 causes the slider 25 to move in an opposite direction. It is also possible to form a slit 32 and a slit 47 in right-hand spirals with different angles, or to form a slit 32 and a slit 47 as left-hand spirals with different angles. Moreover, it is also possible to form either one of a slit 32 and a slit 47 to be parallel with the support shaft 20 and form the other as a right-hand or left-hand spiral.

The slit 47 is formed to have a width slightly larger than the diameter of the slider 25. The inside of the slit 47 is to be sized in such a way that the tip of the slider 25 can be inserted and the slider 25 can slide smoothly along in the longitudinal direction of the slit 47 while remaining in contact with at least one of the pair of guides 49.

Therefore, the slider 25 is placed in such a way so as to communicate with the crossing position of the slit 32 and the slit 47. The slider 25 moves being guided by the guide part 49 of the slit 47, thereby pressing the slanted part 33 of the slit 32. Concequently, the relative rotation angle between the first intervening member 30 and the second intervening member 40 varies.

Therefore, the variable valve mechanism of this embodiment is essentially equal to the first embodiment except that the slider 25, the first intervening member 30 and the second intervening member 40 are constituted differently. Therefore, this embodiment provides a similar effect as the first embodiment.

Figure 13:
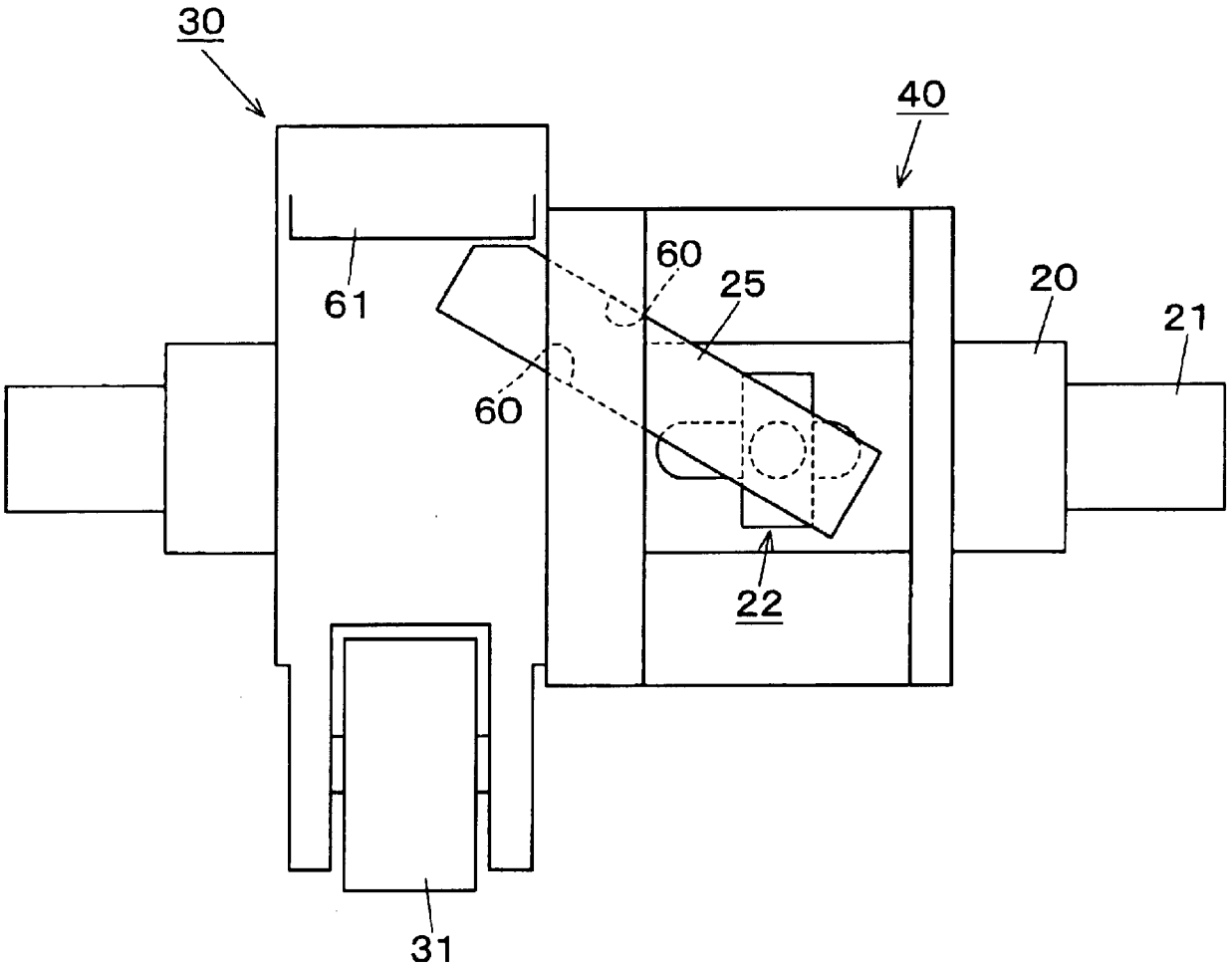
FIG. 13 depicts a plan view of a modified version of the variable valve mechanism of the present invention.
Figure 14:
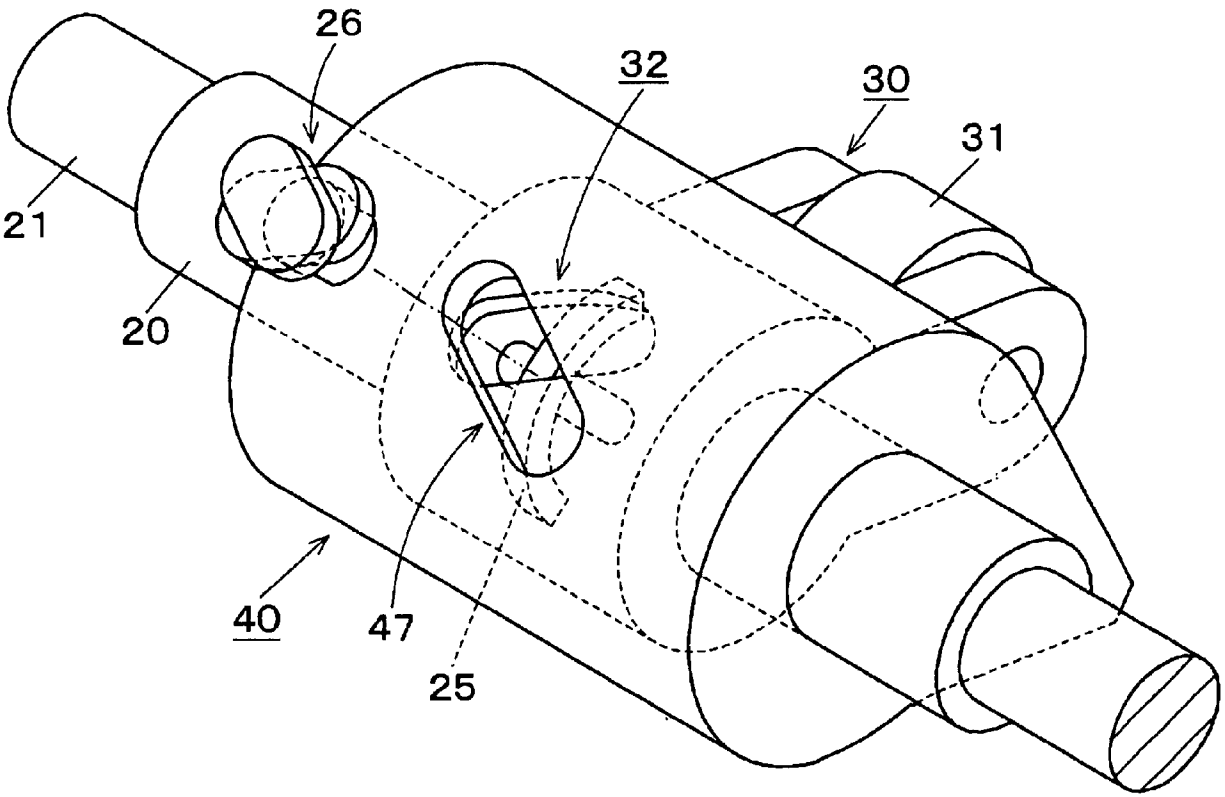
FIG. 14 depicts a perspective view of a further modified version of the variable valve mechanism of the present invention; and, FIG. 15 depicts a perspective view of a prior art variable valve mechanism.
Figure 15:
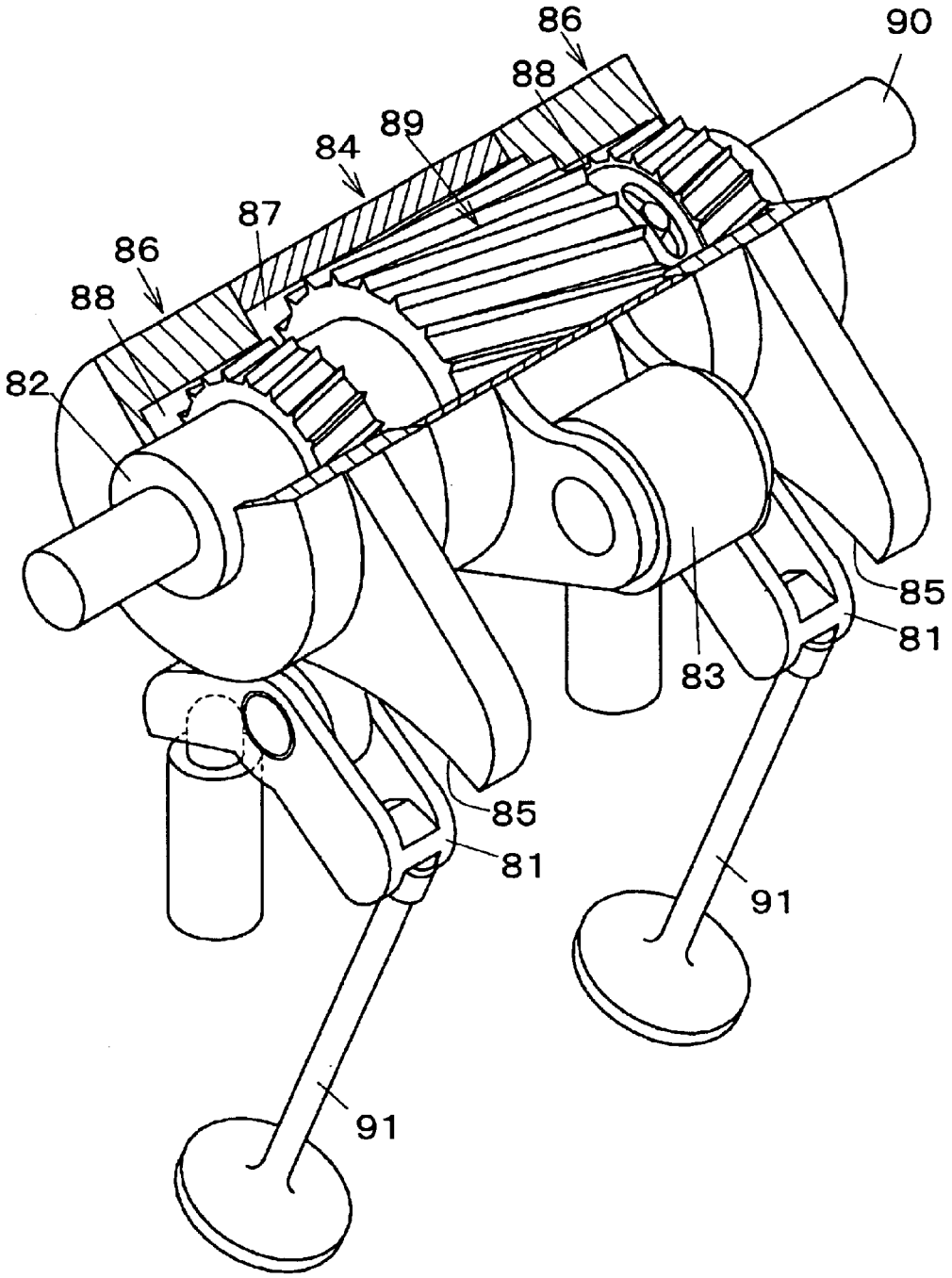
FIG. 15 PRIOR ART

It should be understood that the present invention shall not be limited to the constitutions of said embodiments, and can be implemented with modifications without deviating from the scope of the invention as exemplified below:

(1) to modify the constitution and method of control of the relative rotation angle control device;

(2) to provide the slider 25 and the slanted parts 60 on either one of the first intervening member 30 and the second intervening member 40, and provide a guide part 61 for guiding the displacement of the slider 25 on the other one of the first intervening member 30 and the second intervening member 40 as shown in FIG. 13;

(3) to provide a slider and a guide part for guiding the slider displacement on the first intervening member, while providing the slanted part having a slanted part on the second intervening part;

(4) to modify the slider pin to cross the slider 26 as shown in FIG. 14; and (5) to modify the number of rocker arms by for example, reducing the number of rocker arms to a single rocker arm which makes it impossible to prevent the valve lift variation, but which it makes it possible to produce an inexpensive and compact variable valve mechanism.

It should be also understood that the shape of the slider is not limited but can be, for example, a cylindrical rod, a rectangular rod, and can be arbitrarily chosen according to the shape of the slanted part.

Furthermore, the positional relation between the slider, the slanted part, and the first and second intervening members is not limited and the following four modes can be exemplified:

(1) a mode where the slider is provided on either the first or the second intervening member, while the slanted part is provided also on either the first or the second intervening member, (2) a mode where both the slider and the slanted part are provided on either one of the first or the second intervening member, while a guide part for guiding the slider displacement is provided on the other one of the first or the second intervening member, (3) a mode where the slider and the slanted part having a slit are provide on the first intervening member, while a guide part for guiding the slider displacement is provided on the second intervening member, and (4) a mode where the slider and a guide part for guiding the slider displacement are provided on the first intervening member, while the slanted part having a slanted part is provided on the second intervening part.

In (3) and (4) above, the guide part is not particularly specified for its configuration but rather can be formed to cause the slider's displacement direction to be parallel with the support shaft or in an angle relative to the slanted part.

In addition, the cam corresponding part is not particularly specified for its configuration but rather can be formed to be a hard tip affixed to the rocker arm or a roller rotatably mounted on the rocker arm. However, it is preferable to use a roller rotatably mounted on the rocker arm considering friction resistance and wear.

The location where the first intervening member is pressed against the rotating cam is not particularly specified but rather the contact can be made by means of a hard tip affixed to the rocker arm or a roller rotatably mounted on the rocker arm. However, it is preferable to use a roller rotatably mounted on the first intervening member considering friction resistance and wear.

The number of rocker arms is not limited and can be one or more. When applying the variable valve mechanism according to the present invention to suction valves, the number of rocker arms can be arbitrarily chosen considering the suction efficiency, the space required for mounting the variable valve mechanism, etc. When applying the variable valve mechanism according to the present invention to exhaust valves, the number of rocker arms can be arbitrarily chosen considering, for example, the exhaust efficiency, and the space required for mounting the variable valve mechanism.

The rocker arm can be either of the following types:

(1) a type where the rocking fulcrum is on one end of the rocker arm, the cam corresponding part is in the center, and the valve pressing part is on the other end (so-called swing arm type); or (2) a type where the rocking fulcrum is in the center of the rocker arm, the cam corresponding part is on one end, and the valve pressing part is on the other end.

However, (1) type is preferable because it provides a better space efficiency.

The rocking fulcrum can be exemplified with the following two modes:

(a) a mode wherein the rocking fulcrum is a concave spherical part supported by a pivot; and (b) a mode wherein the rocking fulcrum is a bore rockably supported by a rocker shaft.

It is preferable that the pivot as a rocking fulcrum is provided with a tappet clearance adjusting mechanism adjustable with a screw. The mode (a), for example, can be exemplified by a tappet clearance adjusting mechanism wherein a male screw provide on the pivot can be adjustably screwed into a female screw provided on the pivot support member.

The relative rotary angle control device can be exemplified by such equipped with a helical spline mechanism, a hydraulic drive unit, and a controller such as a microcomputer.

Although the variable valve mechanism according to the present invention can be configured to be applicable only to either one of the suction valve and the exhaust valve, it is preferable to be applicable to both.

The variable valve mechanism of the present invention provides a device with compactness, no fluctuations between the left and right valve lift amounts, that is inexpensive.

While the present invention has been described with respect to a particularly preferred embodiment, the invention is susceptible to implementation in other ways that are within the spirit of the invention which is defined in terms of the recitations of the appended claims and equivalents thereof.

What is claimed is:

1. A variable valve mechanism comprising:

a first intervening member that rotates a small angle rotation about an axis of a support shaft by being pressed by a rotating cam;

a second intervening member that lifts a valve by making a small angle rotation about an axis of said support shaft together with said first intervening member thus pressing a cam corresponding part of a rocker arm;

a control shaft provided concentrically with said support shaft;

a slider that moves with said control shaft;

a slanted part formed diagonally relative to said slider's movement direction, contacting with said slider; and a relative rotation angle control device, wherein said relative rotation angle control device varies the relative rotation angle of said first intervening member and said second intervening member by pressing said slanted part in a direction substantially perpendicular to said slider's movement direction by moving said slider together with said control shaft, thus varying the valve's lift and operating angle continuously.

2. The variable valve mechanism of claim 1 wherein said slider is provided on one of said first intervening member and second intervening member; and said slanted part is provided on the other one of said first intervening member and second intervening member.

3. The variable valve mechanism of claim 1 wherein said slider and said slanted part are provided on either one of said first intervening member and second intervening member; and a guide part for guiding said slider's motion is provided on the other one of said first intervening member and second intervening member.

4. The variable valve mechanism of claim 1 wherein said slider and said slanted part comprising a slit are provided on said first intervening member; and a guide part for guiding said slider's motion is provided on said second intervening member.

5. The variable valve mechanism of claim 1 wherein said slider and a guide for guiding said slider's motion are provided on said first intervening member; and said slanted part comprising a slit is provided on said second intervening member.

* * * * *